United States Patent [19]

Hoos

[11] 4,225,996

[45] Oct. 7, 1980

[54] ROLLER SKATE WHEEL CLEANING APPARATUS

[76] Inventor: Richard E. Hoos, 756 Hill Rd., Brentwood, Tenn. 37027

[21] Appl. No.: 45,354

[22] Filed: Jun. 4, 1979

[51] Int. Cl.[3] ..... A63C 3/00; A47L 23/00

[52] U.S. Cl. ..... 15/97 R; 15/21; 15/3; 15/DIG. 2; 15/53 B

[58] Field of Search ..... 15/21 B, 53 B, 97 R, 15/88, 57–59, 65, 70

[56] References Cited

U.S. PATENT DOCUMENTS

| | | | |
|---|---|---|---|
| 2,209,812 | 7/1940 | Dougherty | 15/34 |
| 2,616,108 | 11/1952 | Luft | 15/21 B |
| 3,218,658 | 11/1965 | Collins et al. | 15/88 |

*Primary Examiner*—Edward L. Roberts

*Attorney, Agent, or Firm*—Sughrue, Rothwell, Mion, Zinn and Macpeak

[57] ABSTRACT

A scouring pad is placed between two parallel rotating rollers mounted in a slot formed in the top of a platform. The lower surfaces of the rollers are wetted by a liquid detergent solution contained in a tank mounted below the platform. A shoe roller skate having a front pair and a rear pair of wheels is placed on the platform with one pair of wheels resting on the rollers and engaging the top of the scouring pad. The rollers rotate the skate wheels against the scouring pad, thereby removing dirt from the skate wheels by an abrading action. The liquid detergent is transferred from the rollers to the skate wheels and scouring pad, thereby enhancing the removal of the dirt from the skate wheels.

10 Claims, 5 Drawing Figures

FIG. 1
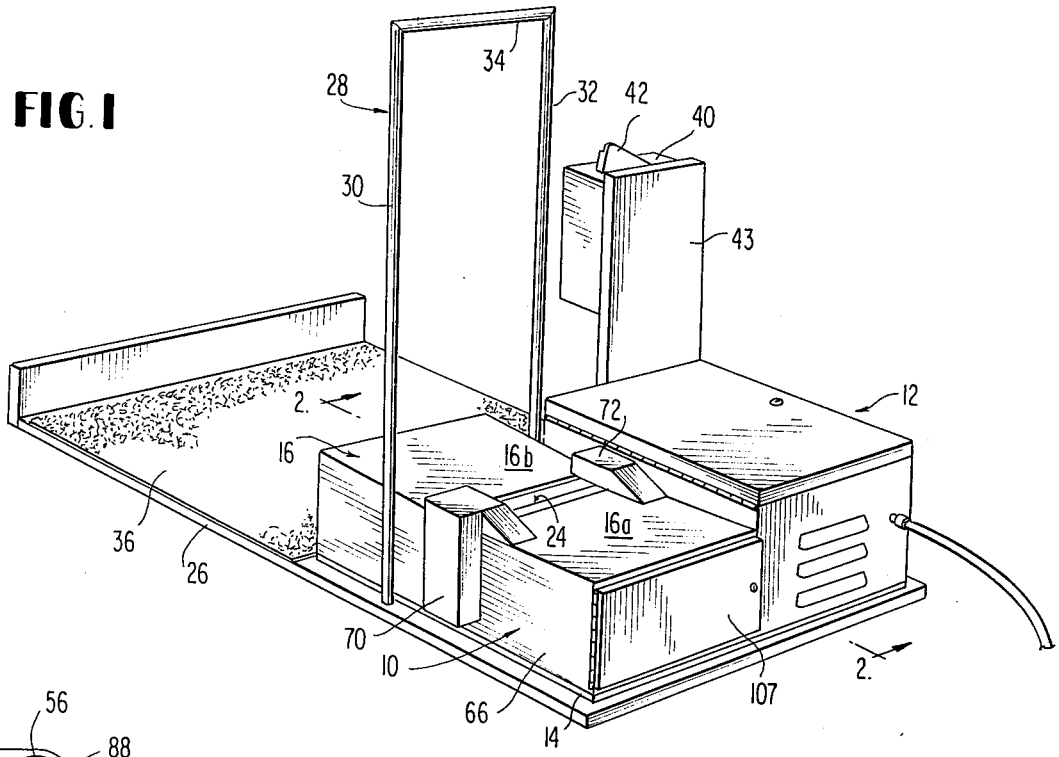
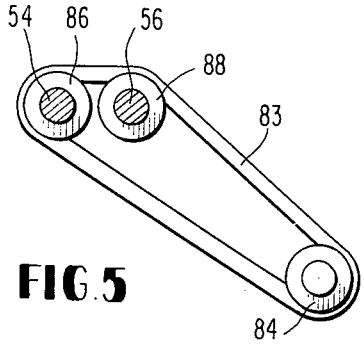
FIG. 5
FIG. 2
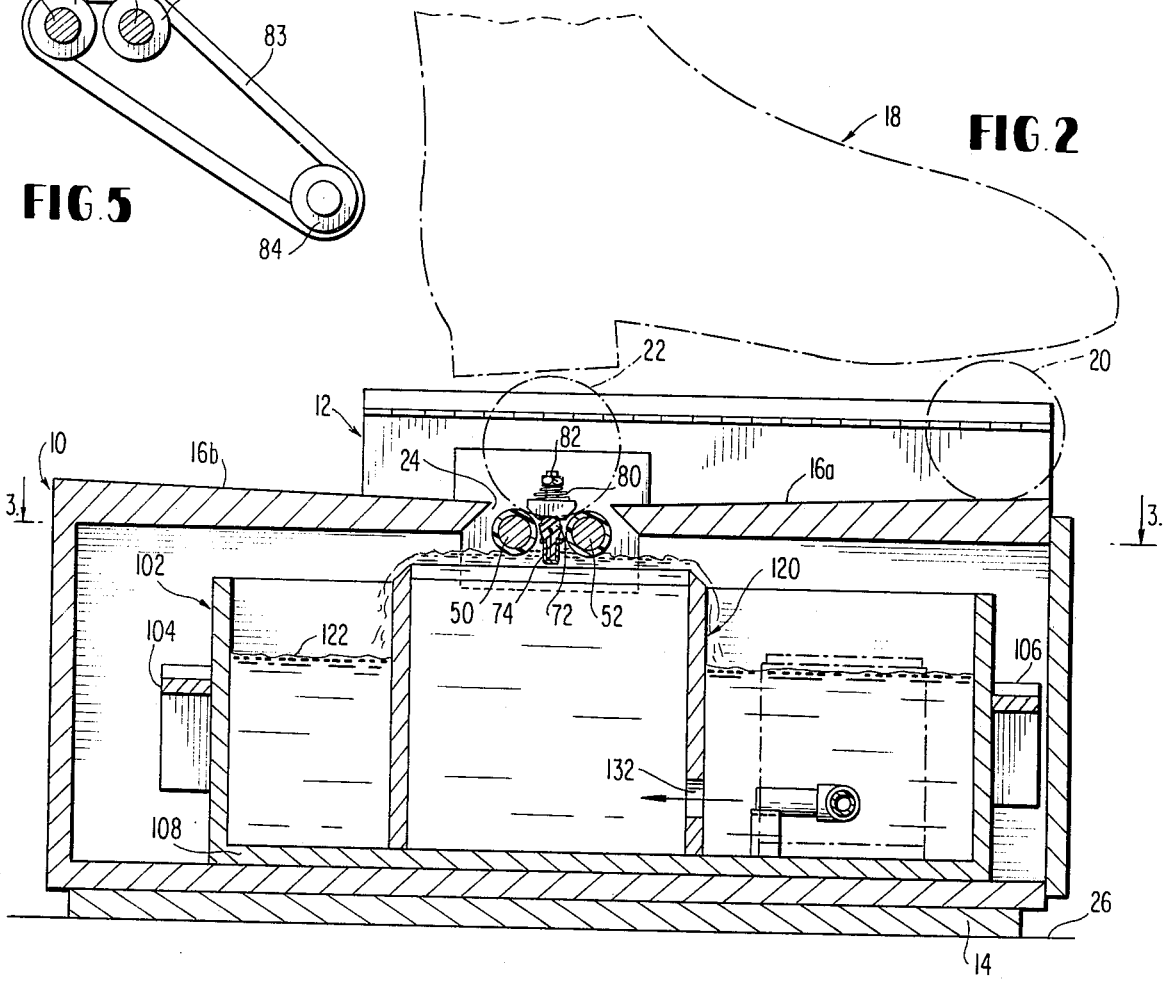

ROLLER SKATE WHEEL CLEANING APPARATUS

BACKGROUND OF THE INVENTION

1. Field of the Invention

This invention relates to the field of roller skate wheel cleaning and, more particularly, to a machine for automatically and efficiently cleaning both wheels of a pair of roller skate wheels at the same time.

2. Description of the Prior Art

In the past, roller skate wheels have been individually cleaned by hand, a process which was very laborious and time consuming. Furthermore, for a commercial skating rink, such a process was very expensive, as it required a great deal of human labor.

SUMMARY OF THE INVENTION

The primary object of this invention is to provide a roller skate wheel cleaning apparatus which is motor driven and permits a skate user to clean a pair of roller skate wheels simultaneously without having to handle the wheels.

Another object of the invention is to provide such a skate wheel cleaning apparatus which is relatively inexpensive and can be used by any skater.

Still another object of the invention is to provide such a roller skate wheel cleaning apparatus which can be used to clean the wheels of a shoe roller skate while the skate is either on the foot of the wearer or off the foot of the wearer.

A further object of the invention is to provide such a roller skate wheel cleaning apparatus which is coin-operated.

BRIEF DESCRIPTION OF THE DRAWING

FIG. 1 is a perspective view of a preferred embodiment of the invention which is coin-operated and which can be placed on the floor so that the wheels of a roller skate can be cleaned while a skater is wearing the roller skate.

FIG. 2 is a sectional view taken along line 2—2 of FIG. 1.

FIG. 5 is a sectional view taken along line 5—5 of FIG. 3.

DESCRIPTION OF THE PREFERRED EMBODIMENT

Figure 3:
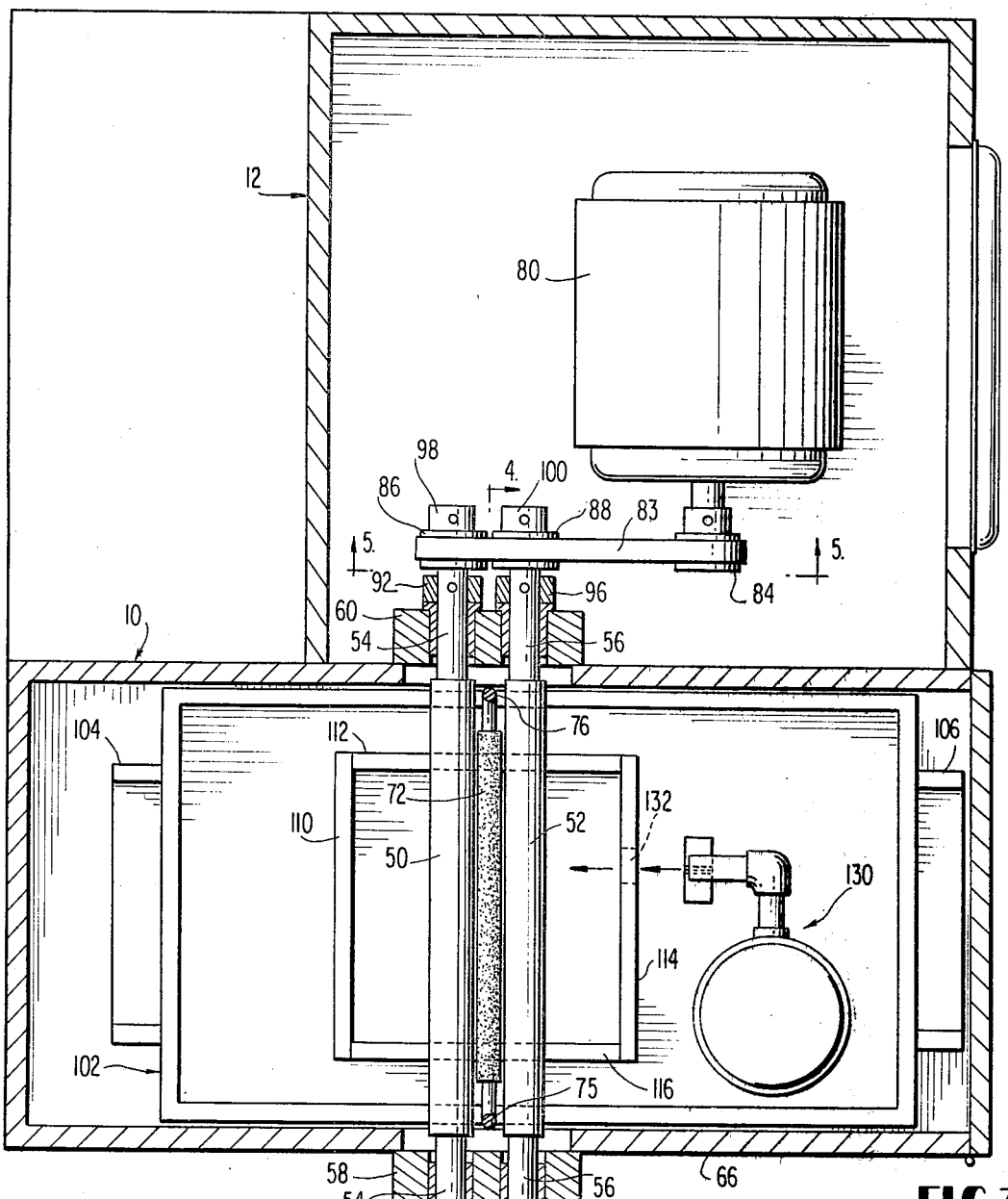
FIG. 3 is a sectional view taken along line 3—3 of FIG. 2.

FIG. 1 is a perspective view showing the exterior structure of the wheel cleaning device. FIG. 2 is a sectional view showing in phantom lines a shoe skate in position for a wheel cleaning operation.

Exteriorly, the basic elements of the wheel cleaning apparatus are a housing 10 enclosing the wheel cleaning apparatus and another housing 12 enclosing the electric motor drive for the wheel cleaning apparatus. These housings are mounted adjacent each other and are securely fixed to a board or other suitable supporting member 14. The top surface of housing 10 is slightly V-shaped and acts as a platform 16 for supporting a shoe skate 18 as shown in phantom lines in FIG. 2. The shoe skate has a pair of front wheels 20 and a pair of rear wheels 22. A horizontal slot 24 is formed in the top of platform 16. As shown in FIG. 2, when the rear wheels

22 are being cleaned, the rear wheels are placed over the slot 24 while the front wheels 20 rest on the inclined platform surface 16*a*. Conversely, if the front wheels 20 are to be cleaned, they are placed over the slot 24 while the rear wheels 22 rest on the inclined platform surface 16*b*.

In one embodiment of the invention, the board 14 carrying the housings 10 and 12 is placed on a table top or other suitable surface, and a shoe skate, not on a skater's foot, may be held by hand on the platform 16 in the cleaning position as shown in FIG. 2.

In another embodiment of the invention, the board 14 is mounted on a base plate 26 which rests on the floor. A hand-grip bar assembly 28 is fixed to the base plate 26 and consists of two vertical bars 30 and 32 joined together at the top by a horizontal bar 34. With this embodiment, a skater may clean his skate wheels while the skate is still on his foot. The skater merely stands on the carpet 36 on the top surface of the base plate 26, grips the assembly 28 to help him maintain his balance, and places one shoe skate on the platform 16 in the cleaning position as shown in FIG. 2.

In another embodiment of the invention, a conventional coin box 40 having a coin slot 42 is fixed to a vertical supporting member 43 which in turn is fixed to the motor housing 12. This embodiment is particularly useful for commercial skating rinks, as skaters may actuate the motor which drives the cleaning apparatus merely by inserting in the slot 42 a coin of predetermined value.

The internal structure and operation of the skate wheel cleaning apparatus will now be described with reference to FIGS. 2–5.

Two parallel horizontal cylindrical rollers 50 and 52 are rotatably mounted in the housing 10. The roller shafts 54 and 56 are rotatably mounted in bearing blocks 58 and 60 fixed to the side walls 66 and 68, respectively, of the housing 10. As shown in FIG. 1, bearing covers 70 and 72 normally cover these bearing blocks.

Figure 4:
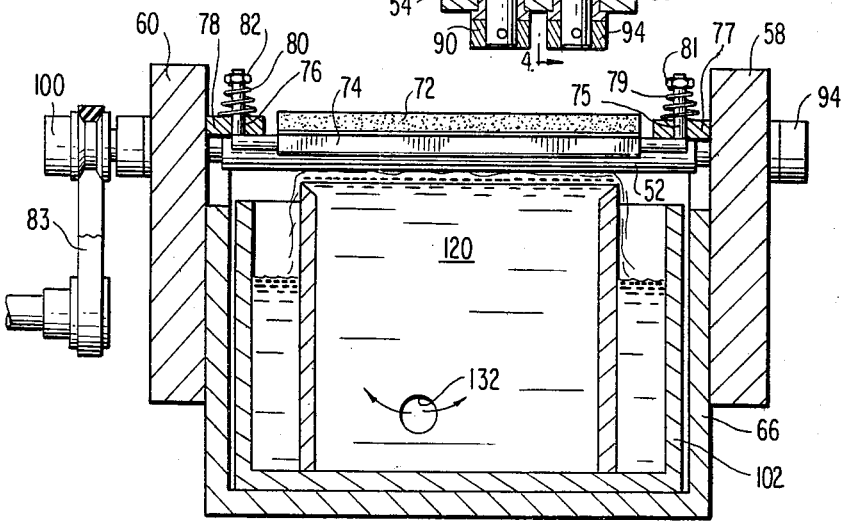
FIG. 4 is a sectional view taken along line 4—4 of FIG. 3.

Rollers 50 and 52 are mounted within the slot 24 in the skate platform 16 and are spaced apart. In the space between the rollers is spring-mounted a skate wheel scouring means in the form of a conventional scouring pad 72 which is folded and held within a U-shaped channel 74. The scouring pad may be a SCOTCH-BRITE, Catalog No. 96, available from 3-M Company. The bottom of the pad itself may be secured to a pad holder which, in turn, is placed in channel 74. The opposite ends of the channel 74 are fixed to the lower ends of respective adjusting bolts 75 and 76 which are slidably supported in respective blocks 77 and 78 fixed to the bearing blocks 58 and 60. Biasing springs 79 and 80 are disposed on the bolts between the stop nuts 81 and 82 and the top surfaces of the respective blocks normally to bias the scouring pad upwardly above the surfaces of rollers 50 and 52 as shown in FIG. 4. Thus, when a pair of skate wheels is placed on top of the rollers, the wheel surfaces engage the pad, and the weight of the skate forces the channel 74 downwardly against the force of the springs until the wheels engage the roller surfaces. Thus, the scouring pad is in continuous contact with the wheel surfaces whenever a skate is in cleaning position. As the scouring pad 72 wears down with use, it may be removed from the channel 74 and replaced with a new pad.

A conventional variable speed electrical motor 80 rotates the rollers 50 and 52 through a pulley and belt mechanism consisting of a belt 83 entrained about the motor shaft pulley 84 and the roller shaft pulleys 86 and 88 fixed to the ends of the roller shafts 54 and 56, respectively, of the rollers 50 and 52. Retaining collars 90, 92 and 94, 96 prevent longitudinal movement of the roller shafts, and the pulley hubs 98 and 100 lock the pulleys 86 and 88, respectively, to their corresponding roller shafts. One roller pulley may be eliminated, so that only the other roller pulley is driven by the belt 82, whereby the first roller is then indirectly driven by frictional engagement with the rotating skate wheels.

Disposed within the housing 10 is a tank 102 having handles 104 and 106 for assisting in the removal of the tank from the housing via a door 107. Integral with the bottom wall 108 of the tank 102 are four vertical walls 110, 112, 114 and 116 which are joined together to form a container. Furthermore, the upper edges of these walls extend above the upper edges of the side walls of the tank 102 and act as weirs. The container effectively formed by these walls is designated by the reference numeral 120. In a modification, the weirs may be formed by the walls of an actual container properly positioned on the floor of tank 102.

In operation, a cleaning fluid, such as a conventional non- or low-sudsing liquid detergent water solution is placed in the tank 102 until the tank is filled to an approximate level as indicated by the surface line 122. The height of the walls of the container 120 is such that the lower surfaces of the rollers 50 and 52 rotate through the detergent in the container 120. As the rollers rotate, they are wetted by the liquid detergent, and the detergent is transferred to the roller skate wheel 22 and to the scouring pad 72, thus assisting in the cleaning action of the scouring pad and also removing the dirt which may be loosened by the scouring pad. The dirty water falls into the top of the container 120 and overflows the weirs formed by the top edges of the walls of the container 120. An immersible circulating pump and discharge assembly 130 continuously pumps the cleaning fluid in the tank 102 into the container 120 through an opening 132 formed in the lower end of the wall 114 of container 120, thereby maintaining the waterfall action over the weirs. Assembly 130 contains a filter for removing the dirt from the recirculated water, and the filter may be cleaned periodically.

In the modification, the cleaning apparatus and motor may be contained within a single housing formed of molded plastic and having a floor member to which is releasably attached a cover of sufficient height to enclose the complete cleaning apparatus. Again, the top surface contains a horizontal slot for exposing the rollers and scouring pad. In this case, the bearing blocks are secured to the floor member, rather than to the sides of the housing.

Even though preferred embodiments of the invention have been disclosed herein, obvious modifications of these embodiments will be apparent to those skilled in the art, and the true scope of the invention is defined in the following claims.

I claim:

1. A roller skate wheel cleaning apparatus for cleaning the wheels of a roller skate having a front pair of wheels and a rear pair of wheels, and comprising:

a housing;

a pair of parallel horizontal roller means for simultaneously frictionally engaging the skating surfaces of both wheels of a pair of skate wheels, said roller means being mounted for rotation relative to said housing and being spaced apart;

scouring means for cleaning the skate wheels and being mounted in the space between said roller means for engaging said surfaces of said skate wheels when said roller means are frictionally engaging said skate wheels;

drive means for driving at least one of said roller means so that, when said roller means are frictionally engaging the skate wheels, the skate wheels are rotated to continuously move the surfaces thereof across said scouring means; and a container of cleaning fluid mounted in said housing below said roller means so that the surfaces of said roller means contact the cleaning fluid and are wetted thereby.

2. A roller skate wheel cleaning apparatus for cleaning the wheels of a roller skate having a front pair of wheels and a rear pair of wheels, and comprising:

a housing;

a pair of parallel horizontal roller means for simultaneously frictionally engaging the skating surfaces of both wheels of a pair of skate wheels, said roller means being mounted for rotation relative to said housing and being spaced apart;

scouring means for cleaning the skate wheels and being mounted in the space between said roller means for engaging said surfaces of said skate wheels when said roller means are frictionally engaging said skate wheels;

drive means for driving at least one of said roller means so that, when said roller means are frictionally engaging the skate wheels, the skate wheels are rotated to continuously move the surfaces thereof across said scouring means;

wherein said housing comprises platform means for supporting a roller skate, said platform means containing a horizontal slot extending in the direction parallel to said roller means;

means for mounting said pair of roller means in said horizontal slot so that, when one pair of wheels is frictionally engaged by said roller means, the other pair of wheels is resting on said platform means;

horizontal base plate means fixed to the bottom of said housing and adapted to be placed on the floor for permitting a skater wearing a skate to place the skate on said platform means so that one pair of skate wheels is in frictional engagement with said pair of roller means; and hand-grip means, fixed to said base plate means and extending vertically upwardly therefrom, for being held by a skater to maintain his balance when a skate is on said platform means.

3. A roller skate wheel cleaning apparatus for cleaning the wheels of a roller skate having a front pair of wheels and a rear pair of wheels, and comprising:

a housing;

a pair of parallel horizontal roller means for simultaneously frictionally engaging the skating surfaces of both wheels of a pair of skate wheels, said roller means being mounted for rotation relative to said housing and being spaced apart;

scouring means for cleaning the skate wheels and being mounted in the space between said roller means for engaging said surfaces of said skate wheels when said roller means are frictionally engaging said skate wheels;

drive means for driving at least one of said roller means so that, when said roller means are frictionally engaging the skate wheels, the skate wheels are rotated to continuously move the surfaces thereof across said scouring means;

wherein said housing comprises platform means for supporting a roller skate, said platform means containing a horizontal slot extending in the direction parallel to said roller means, and wherein said platform means comprises two platform surfaces on opposite sides of said horizontal slot, each of said surfaces being inclined downwardly in the direction of said slot; and means for mounting said pair of roller means in said horizontal slot so that, when one pair of wheels is frictionally engaged by said roller means, the other pair of wheels is resting on said platform means.

4. The apparatus claimed in claim 1 further comprising:

a tank in said housing and containing cleaning fluid, said container being mounted within said tank so that cleaning fluid overflowing the top of said container falls into said tank; and recirculating pump means for pumping the cleaning fluid from said tank into the bottom end of said container.

5. The apparatus claimed in claims 1, 4, 2 or 3 wherein said drive means is mechanically coupled to both of said roller means for driving both roller means.

6. The apparatus claimed in claim 5 wherein said drive means comprises an electric motor and means mechanically coupling said motor to both of said roller means.

7. The apparatus claimed in claims 1, 4, 2 or 3 further comprising means for regulating the vertical height of said scouring means to maintain said scouring means in engagement with the surfaces of the skate wheels when said roller means are frictionally engaging the skate wheels.

8. The apparatus claimed in claims 1 or 4 wherein said housing comprises platform means for supporting a roller skate, said platform means containing a horizontal slot extending in the direction parallel to said roller means; and wherein said apparatus further comprises means for mounting said pair of roller means in said horizontal slot so that, when one pair of wheels is frictionally engaged by said roller means, the other pair of wheels is resting on said platform means.

9. The apparatus claimed in claims 1, 4, 2 or 3 further comprising coin-operated means for actuating said drive means upon the insertion of a coin of predetermined value.

10. The apparatus claimed in claims 1, 4, 2 or 3 wherein said drive means comprises an electric motor and means mechanically coupling said electric motor to said one roller means.

* * * * *